United States Patent [19]

de Denus

[11] 4,225,571

[45] Sep. 30, 1980

[54] ELECTROWINNING OF METAL FROM SULPHIDE ORES AND RECOVERY OF WATER SOLUBLE SULPHIDES

[75] Inventor: Robert N. de Denus, Wishart, Australia

[73] Assignees: Berenice Isabelle de Denus; David Vivian Smith; Jennifer May Smith, all of Queensland, Australia

[21] Appl. No.: 19,045

[22] Filed: Mar. 9, 1979

[51] Int. Cl.[3] ..... C01B 17/22; C01B 17/42; C01C 1/20; C25C 1/22

[52] U.S. Cl. ..... 423/561 A; 75/101 R; 75/103; 75/117; 75/120; 75/121; 204/105 R; 204/106; 204/114; 423/87; 423/98; 423/109; 423/561 R

[58] Field of Search ..... 423/87, 561 R, 561 A, 423/98, 109; 204/105 R, 106, 114, 120; 75/101 R, 103, 117, 120, 121

[56] References Cited

U.S. PATENT DOCUMENTS

| | | | |
|---|---|---|---|
| 459,023 | 9/1891 | Schreiber et al. | 204/105 R |
| 2,329,816 | 9/1943 | Betterton et al. | 423/87 X |
| 3,883,635 | 5/1975 | Morey et al. | 423/87 |
| 3,911,078 | 10/1975 | Nadkarni et al. | 423/87 |
| 3,969,202 | 7/1976 | Albrethsen et al. | 204/105 R |
| 4,051,220 | 9/1977 | Coltrinari | 423/87 X |

FOREIGN PATENT DOCUMENTS

| | | | |
|---|---|---|---|
| 9919 | of 1886 | United Kingdom | 423/87 |
| 11123 | of 1904 | United Kingdom | 423/87 |
| 1484976 | 9/1977 | United Kingdom . | |

OTHER PUBLICATIONS

Chem. Abstracts, 21908e, vol. 55, (1961).

*Primary Examiner*—G. L. Kaplan
*Attorney, Agent, or Firm*—Schwartz, Jeffery, Schwaab, Mack, Blumenthal & Koch

[57] ABSTRACT

Process and apparatus for the electrowinning of metals from sulphide ores wherein a sulphide ore is initially leached in a water soluble sulphide solution, alkali is then added, and the resulting solution is electrolyzed so as to deposit metal at the cathode and obtain water soluble sulphide as a by-product. The process is particularly suitable for obtaining antimony from stibnite.

14 Claims, 1 Drawing Figure

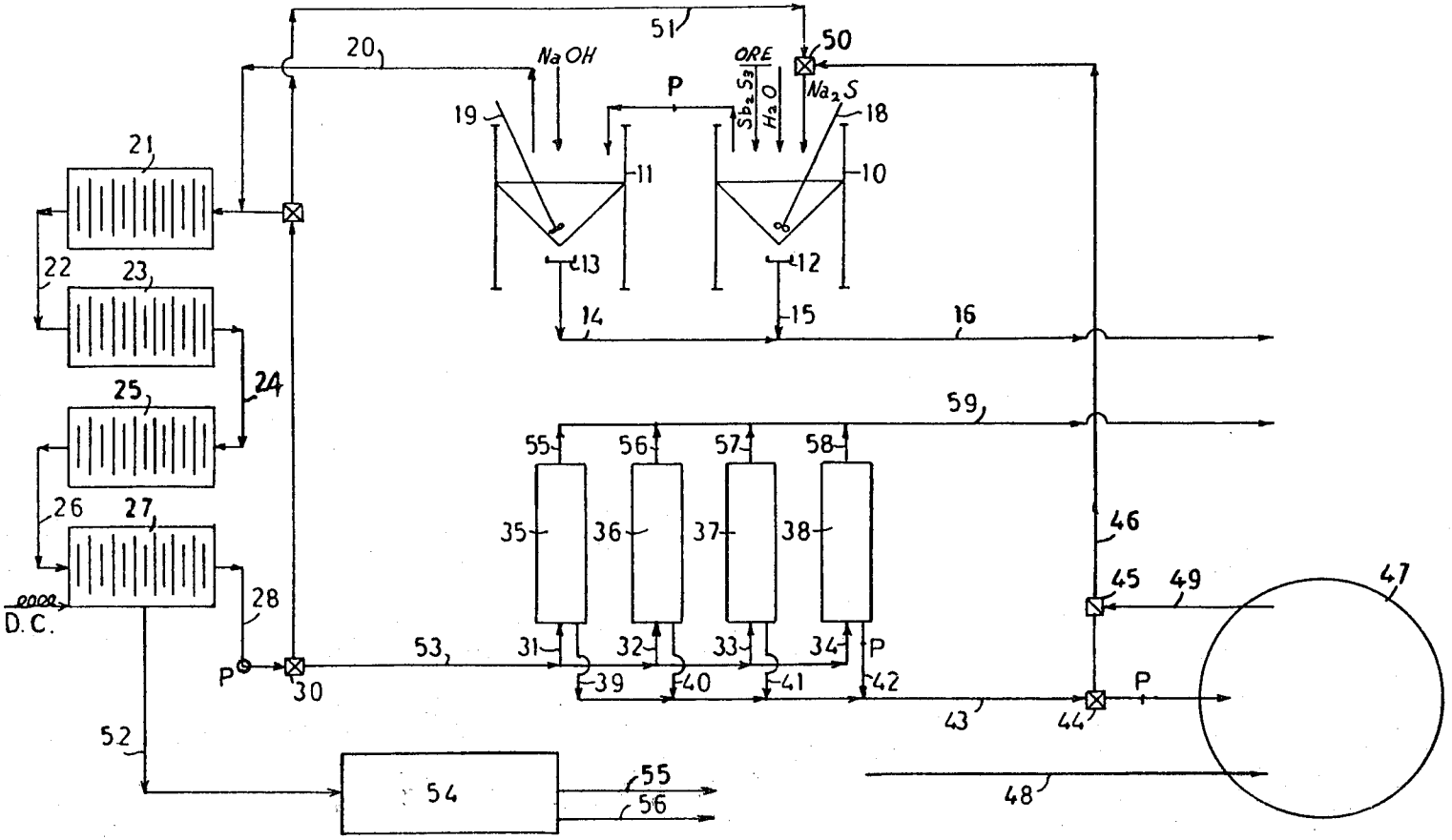
ORE
$Sb_2S_3$
$H_2O$
$Na_2S$
NaOH
P
D.C.

ELECTROWINNING OF METAL FROM SULPHIDE ORES AND RECOVERY OF WATER SOLUBLE SULPHIDES

BACKGROUND OF THE INVENTION (1) Field of the Invention

This invention relates to the electrowinning of metals from sulphide ores and in particular to the obtaining of valuable by-products, such as water soluble sulphides.

(2) Description of the prior art

Hitherto there has not been developed a satisfactory process for the obtaining of water soluble sulphides in conjunction with the refining of metals wherein the twin advantages of obtaining the sulphide on a commercial basis as well as the desired metal could be enjoyed. Water soluble sulphides such as sodium sulphide have a number of commercial applications such as in the tanning and pickling industries.

So far sodium sulphide has been produced from the reduction of sodium sulphate with carbon in a reverbatory furnace or alternatively from bubbling hydrogen sulphide through a caustic soda solution.

BRIEF SUMMARY OF THE INVENTION

It is therefore an object of the invention to provide a process of refining of sulphide ore in order to obtain a desired metal and at the same time provide a water soluble sulphide which may be obtained on a commercial basis.

A further object of the invention is to provide apparatus for carrying out the above-mentioned process.

The invention therefore provides a method of producing a water soluble sulphide as a by-product of the electrowinning of metals from sulphide ores which includes the steps of:

(a) leaching the sulphide ore in a water soluble sulphide solution;

(b) adding alkali to the solution of step (a); and (c) electrolysing the solution of step (b) so as to deposit metal at the cathode and obtain the water soluble sulphide.

The invention also provides an apparatus suitable for carrying out the above-mentioned process including:

(i) at least one primary leaching tank wherein the sulphide ore is leached in the presence of a water soluble sulphide;

(ii) at least one secondary leaching tank and transferring means between said at least one secondary tank and said at least one primary tank for transferring resulting solution from said at least one primary tank for addition of alkali;

(iii) at least one electrolytic cell for electrolysis of solution from said at least one second tank and means for transferring of solution from said at least one secondary tank to said at least one electrolytic cell;

(iv) means for removal of deposited metal from the cathode of said at least one electrolytic cell;

(v) at least one crystalliser and means for transferring of solution from said at least one electrolytic cell to said at least one crystalliser;

(vi) means for transfer of crystals from said at least one crystalliser for subsequent collection;

(vii) means for removal of mother liquor from said at least one crystalliser and recycling said mother liquor back to said at least one primary leaching tank.

The process of the invention is suitable for electrolytic refining of any metal found in sulphide ores wherein a water soluble sulphide may also be obtained such as the sulphide ores of copper, nickel and lead. However the invention is particularly suited for the production of metals referred to in qualitative chemical analysis as the tin group which includes mercury, arsenic, antimony and tin. Water soluble sulphides which also are most conveniently obtained are those of the alkali metal or alkaline earth metal groups such as sodium sulphide, calcium sulphide and potassium sulphide. Ammonium sulphide may also be obtained. The term "water soluble sulphide" may also include within its scope polysulphides.

BRIEF DESCRIPTION OF THE DRAWING

The drawing represents a flow sheet diagram of a pilot plant for conducting the method of the invention.

DETAILED DESCRIPTION OF THE INVENTION

However it will be appreciated that the invention should not be limited to these example applications. For the sake of convenience the invention will hereinafter be discussed in relation to the electrolytic refining of antimony from antimony bearing ores such as stibnite. The process is also applicable in relation to this example embodiment to concentrates or to the products(s) resulting from the fusion or admixture of antimony bearing materials in the presence of sulphur or sulphur compounds such as matte or speiss.

Therefore, in a particularly preferred form of the invention, the leaching step may involve the leaching of antimony bearing ore such as stibnite with a water soluble sulphide which may also include a polysulphide. Again for the sake of convenience, sodium sulphide will be referred to hereinafter as an appropriate water soluble sulphide.

Conveniently the leaching step involving the reaction between the stibnite ore and sodium sulphide is carried out in a primary leaching tank. More than one primary leaching tank may be utilized if required. Any appropriate leaching temperature may be utilized such as room temperature but desirably the leaching temperature falls between 50°–100° C. and more preferably between 70°–85° C.

The stibnite ore is desirably added to the primary leaching tank in a maximum amount, for example so as to impart an antimony concentration to the leaching solution of between 250–300 g/liter. This is because it is desired to keep the amount of free sodium sulphide in the solution to a minimum as too high a concentration of free unreacted sodium sulphide results in a reduction in current efficiency during the electrolysis step. Preferably the leaching solution is agitated.

The actual form of the reaction during the leaching step is uncertain. However, because of the end reaction and product obtained, it is believed that the use of sodium sulphide to dissolve stibnite results in the formation of sodium thio-antimonite as shown by the following reaction:

$$Sb_2S_3 + Na_2S = 2NaSbS_2$$

After dissolution of the stibnite in the sodium sulphide solution, desirably the leaching solution is transferred to a secondary leaching tank or tanks wherein an alkali is added. The alkali may be any appropriate source of $OH^-$ ions but for convenience and saving of cost NaOH or KOH is preferred. NaOH is especially preferred.

The amount of NaOH added is desirably such as to impart a concentration of at least the same an antimony in the solution, e.g. between 250–300 G/liter. Stoichiometrically, the amount of caustic soda added should be sufficient to satisfy the following equation during electrolysis; i.e.

$$4NaSbS_2+12NaOH=4Sb\downarrow+8Na_2S+6H_2O+3O_2$$

The solution may then be passed from the secondary leaching tank to an electrolytic cell. In this step any appropriate anode may be utilized such as steel or lead. The cathode may be of any appropriate type such as mild steel. The electrolytic cell may be rectangular shape but this is not essential. The voltage between the cathode and anode is desirably within the range of 2 to 3 volts depending on the concentration of the solution and the temperature. Any suitable temperature may be utilized such as between 40°–100° C. More preferably the temperature is between 50°–60° C. Any suitable range of current densities may be utilized such as between 5–30 Amps/Sq.Ft. Desirably 10 Amps/Sq.Ft. may be utilized.

A plurality of electrolytic cells is desirably utilized in the electrolysis step such as four which are each connected in series with a conduit being provided between each adjacent cell. There also may be provided a conduit between the first and last cell for recycling of electrolyte if required. Each cell may be equipped with a mechanical stirrer if required.

During the electrolysis step the antimony is deposited on the cathode, and is periodically removed to allow the recovery of the deposited antimony. At the same time oxygen is liberated at the anode and the sodium sulphide produced goes into solution.

The cathode reaction is:

$$4Na^++4SbS_2^-+12e^-=4Sb\downarrow+4Na^++8S^=$$

The anode reaction is:

$$12Na^++12OH^-=12Na^++6H_2O3O_2\uparrow+12e^-$$

The full reaction can be written as:

$$4NaSbS_2+12NaOH=4Sb\downarrow+8Na_2S+6H_2O+3O_2\uparrow$$

After the electrolyte has been substantially stripped of its antimony content (e.g. depleted to between 25–35 g/liter) to an isolation vessel for recovery of the sodium sulphide such as a shallow pan or crystallizer. In this procedure colourless crystals of sodium sulphide separate out from the solution. If desired the electrolyte containing 25–35 g/liter of antimony may be further electrolysed to reduce the antimony concentrate down to an appropriate level for use in industry, e.g. about 5 g/liter.

Desirably portion of the electrolyte is transferred or recycled to the primary leaching vessel wherein the sequence steps (a), (b) and (c) may be again carried out. This sequence may be repeated a number of times, with the electrolyte being recycled to the primary leaching tank in each case.

EXAMPLE 1

(Example of process of invention in laboratory)

A leaching solution of 10 liters was made up, containing 2.5 kilograms of 60% grade Sodium Sulphide flakes. Temperature of the solution was kept at 85° C. and 5 kilograms of finely ground material assaying 61% Antimony and 4.5% Arsenic were added to the solution. The solution was stirred for one hour using a handyman electric drill.

The solution was then transferred to a second 20 liter container where 2.5 kilograms of 99% Caustic Soda were dissolved in the solution. An aliquot was taken for analysis and the solution left to cool to 50° C.

The solution contained 250 grams/liter of Antimony.

The solution was then transferred to a rectangular shaped steel cell where temperature was kept constant by an immersion heater controlled with a thermostat.

Direct current was applied, subjecting the solution to electrolysis. Different current densities and temperatures were experimented with but the most satisfactory conditions found to be of the following nature:

Current density: 10 Amps/Sq.Ft.

Temperature: 50° to 60° C.

The solution was depleted of its Antimony until it contained 25 grams of Antimony per liter. Half of the solution was discarded and the other half recycled for use in a new leaching step.

In one exercise the original solution was used to make 10 cycles, that is: depleting the solution from leaching to electrolysis to 25 to 35 grams per liter of Antimony and repeating the sequence of steps (a), (b) and (c).

At the end of this particular exercise the solution was subjected to electrolysis until the solution contained only 5 grams per liter of Antimony. The solution was then diluted to contain 250 grams of Sodium Sulphide.

A portion of the solution was left to cool in a shallow dish (1 liter) overnight. Large colourless crystals of Sodium Sulphide separated out. The Sodium Sulphide crystals were analysed for Antimony content and found to contain only 0.05% of Antimony. It has been ascertained from enquiry of the pickling and tanning trades that this level of Antimony would not be detrimental to the use of Sodium Sulphide in industry.

The Antimony metal was recovered with current efficiency averaging 70% producing a metal of high quality assaying 99.8% Antimony with no Arsenic detected after being subjected to thermal fusion and poured into ingots.

EXAMPLE 2

The above experiment was duplicated at pilot plant level and results obtained were comparable.

In the pilot plant apparatus shown in the flow sheet drawing, the stibnite ore, water and sodium sulphide are introduced into primary leaching tank 10 as shown through separate inlets. The tank 10 is equipped with mechanical stirrer 18. The leaching solution comprises 250 g/liter of $Na_2S\ 3H_2O$ (60%) or 500 g/liter of $Na_2S\ 9H_2O$.

After the reaction described above has occured in tank 10, the pregnant solution having a concentration of 250 g/liter of antimony and 250 g/liter of NaOH is passed with the agency of a pump into secondary leaching tank 11 through line 17. Tank 11 is equipped with mechanical stirrer 19. After the NaOH is suitably dissolved in the solution in tank 11, the solution is passed into electrolytic cell 21 through line 20.

It will be noted that the process of the invention is suitable for recovery of precious metals from the leach residue in tanks 10 and 11, and this residue is passed into collectors 12 and 13 passed into line 16 for later recovery through lines 14 and 15.

The solution is successively passed through electrolytic cell 21, through line 22 into cell 23, through line 24 into tank 25, through line 26 into tank 27 and out through line 28 wherein through the action of control valve 30 the electrolyte may be recycled to tank 10 when required. Through the action of control valve 30 the electrolyte or depleted solution having a concentration of 500 g/liter of $Na_2S$ $9H_2O$ (30%) may also be passed through line 53 into crystalliser pans 35, 36, 37 and 38 through inlet lines 31, 32, 33 and 34 respectively.

In relation to cell 27, the deposited antimony from the cathodes in the cells may be passed into line 52 and into processing tank 54 wherein the metal in relatively pure form may be obtained from outlet line 56. Outlet line 55 serves to obtain antimony derivatives wherein the antimony passed into tank 54 may be converted to the trioxide.

After crystallisation has occurred in crystalliser pans 35–38, the crystals of sodium sulphide may be separated through outlet lines 55, 56, 57 and 58 and collected in line 59 for packing and market.

The mother liquor from pans 35–38 may be collected in line 43 from outlet lines 39, 40, 41 and 42 and may be either passed into line 46 by the action of control valve 44 wherein it can be recycled back to tank 10 through the action of control valve 50 which selectively opens line 51 or 46. Through the action of control valve 44 the mother liquor may be passed through the agency of a pump into a holding and/or surge tank 47 which is supplied with make up wash water through line 48. Water from tank 47 may be passed back into line 46 by the action of control valve 45.

The current density in the cells was about 20 Amps/Sq.Ft. and the voltage 2–3 volts (D.C.). The current efficiency was of the order of 75% and temperature was 60° C. In the pilot plant the water evaporation occurred at the rate of 1.5 liters per kg. of antimony produced at temperatures of 60° C. The leaching tanks had a volume of 2200 liters, the cell volume was 500 liters and each cell was constructed of fibreglass. The cathode area was 6 sq.ft. and each crystalliser pan had a volume of 280 liters.

At pilot plant level 2,000 liters of solution was prepared to contain 150 grams per liter of sodium sulphide, 250 grams per liter of antimony and 250 grams per liter of caustic soda. The final solution was subjected to electrolysis in 4×500 liters fibreglass cells. In this manner approximately 3 tons of antimony metal was produced and 4.5 tons of sodium sulphide was also produced and used to sustain the process on a scale 3 times the original scale of 2,000 liters.

Concentrations of sodium sulphide are important to the process although any concentration of sodium sulphide can be used to dissolve the stibnite.

An excess of sodium sulphide would result in a reduction of current efficiency during electrolysis.

Concentration of caustic soda is particularly important, if the concentration is too low, sulphuric acid will form at the anode surface which will react with the various sodium, sulphur and antimony salts in solution to produce oxidized sulphur compounds and hydrogen sulphide which is evolved.

If the concentration of caustic soda is sufficient virtually no hydrogen sulphide is evolved. Normally little oxidised sulphur compounds are produced because the hydrogen sulphide when evolved can be detected in 0.1 parts per million concentration in the air by its sharp and characteristic odour. Therefore, the problem can immediately be recognised and remedied. The production of sulphuric acid at the anode also showed that it attacked the anode made of pure lead.

For this reason the concentration used in the above examples are preferred. However, should the process be wrongly applied, therefore resulting in the production of Sulpho Salts, which are undesirable in the final sodium sulphide products a number of remedies are at hand which are commonly used in industry.

One would consist in crystallizing the sodium sulphide along with the deleterious salts out of their solution and reducing them with carbon, i.e. a furnace.

Another would consist in treating the solution with barium sulphide, to reduce all the sulpho salts of sodium to sodium sulphide and recovering the insolubles sulpho salts of barium produced to reduce them in turn in a furnace with carbon.

Provided the process is well applied, little caustic soda, antimony or oxidized sulphur compounds should be present in the sodium sulphide.

Although the amount of antimony in the sodium sulphide produced is low, this could be judged undesirable. The antimony and/or antimony salts in the solution can be precipitated out of the solution by adding lime or lime water to the mother liquor.

Although this invention deals mainly with the production of sodium sulphide it also provides an economical process for the refining of the tin group of metals and is specially suited to antimony.

It should be understood that the reaction conditions referred to in the above example are conditions found preferable during experimentation and that different conditions such as concentrations temperatures etc. can be applied without departing from the basic idea of the process.

It must also be understood that the reaction between sodium sulphide and stibnite is possibly more complex than explained above. However, it seems that other products can be produced from the reaction between sodium sulphide and stibnite such as sodium antimony sulphide ($Na_2$ $Sb_4$ $S_7$) and/or sodium thio-antimonate. These products will also produce sodium sulphide when mixed with caustic soda and subjected to electrolysis.

During crystallization if the process is well applied the mother liquor should contain very little oxidised sulphur compounds, less than 5 grams per liter of antimony and less than 5 grams per liter of caustic soda.

If too much caustic soda is left it could be detrimental to the next leach by forming some insoluble meta-antimonite or its product of decomposition. However, this problem was not encountered with leaching solutions containing as much as 100 grams per liter of caustic soda with the sodium sulphide solution. Should it be found undesirable to have caustic soda present in the mother liquor of crystallization or in the leaching solution the caustic soda can be eliminated by bubbling hydrogen sulphide through the solution. This is a classical method of producing sodium sulphide.

It will be remembered that the caustic soda is roughly in the same concentration as the antimony concentration and that the caustic soda is depleted simultaneously to the depletion of the antimony content.

During crystallization the high solubility of caustic soda is taken to advantage not to contaminate the sodium sulphide crystals. Because of its high solubility the caustic soda remains in solution when the sodium sulphide crystals separate out.

Alkaline sulphides such as sodium sulphide have a number of commercial applications, such as in the tanning and paper making trades. The metals produced during electrolysis such as antimony is in addition to the alkaline sulphide produced and is an added bonus to the value of the process.

Another advantage of the process is that it is pollution free. This should be regarded as a major asset of the invention. The process is non-polluting because all the constituent elements of the raw materials which consist of sodium, sulphur and antimony are used to produce commercially valuable products namely, antimony metal and sodium sulphide.

Also, previous metals or other valuable products contained in the treated material can be recovered in the leach residue.

The process is relatively inexpensive and simple to apply and does not require highly complicated or expensive machinery or equipment.

I claim:

1. A method of obtaining antimony from stibnite ore including the steps of:

(a) leaching in a leaching vessel the stibnite ore in a concentrated solution of a water soluble sulphide and in the absence of $OH^-$ wherein the concentration of sulphide ion is approximately the same as the concentration of antimony whereby the following reaction occurs:

$$Sb_2S_3+S^{-2}\rightarrow 2SbS_2^-$$

(b) transferring the leaching solution containing $SbS_2^-$ to a separate reaction vessel and adding a solution containing $OH^-$ in an amount sufficient to yield an $OH^-$ concentration in the solution approximately the same as the concentration of antimony, and (c) electrolyzing the solution after step (b) in an electrolytic cell to deposit antimony metal at the cathode according to the reaction:

$$4SbS_2+12OH^-\rightarrow 4Sb\downarrow+8S^{-2}+6H_2O+3O_2.$$

2. A method as claimed in claim 1 wherein caustic soda is added to said leaching solution in step (b).

3. A method as claimed in claim 1 wherein a portion of the solution obtained after step (c) is recycled to a leaching vessel wherein step (a) is carried out.

4. A method as claimed in claim 3 wherein the recycling is effected when the solution of step (c) is depleted of its antimony concentration to between 25–35 g/liter.

5. A method as claimed in claim 4 wherein the sequence of step (a), step (b) and step (c) is further carried out until again the antimony concentration of the electrolysed solution is between 25–35 g/liter, and portion of said electrolysed solution is again recycled for a further leaching step, the said sequence being repeated a plurality of times.

6. A method as claimed in claim 4 or 5 wherein the solution containing 25–35 g/liter of antimony is further electrolysed so that a final concentration of 5 g/liter is obtained before the water soluble sulphide is isolated.

7. A method as claimed in claim 1 wherein the electrolysis temperature is between 50°–60° C.

8. A method as claimed in claim 1 wherein the leaching step (a) is carried out at a temperature of between 50°–100° C.

9. A method as claimed in claim 8 wherein the leaching step (a) is carried out at a temperature of between 70°–85° C.

10. A method as claimed in claim 1 wherein the concentration of $OH^-$ ion in step (b) is approximately 250 g/l.

11. A method as claimed in claim 1 wherein the concentration of sulphide ion in step (a) is approximately 250 g/l.

12. A method as claimed in claim 1 or 11 wherein the sulphide obtained in step (c) is an alkali metal or alkaline earth metal sulphide.

13. A method as claimed in claim 12 wherein the sulphide is selected from the group consisting of calcium, sodium and potassium.

14. A method as claimed in claim 13 wherein the sulphide is sodium sulphide.

* * * * *

UNITED STATES PATENT AND TRADEMARK OFFICE

CERTIFICATE OF CORRECTION

PATENT NO. : 4,225,571

DATED : September 30, 1980

INVENTOR(S) : Robert N. de Denus

It is certified that error appears in the above—identified patent and that said Letters Patent is hereby corrected as shown below:

In the title page at [73], the middle name of the last assignee, "May", should be replaced by --Mary--.

Signed and Sealed this

*Fifteenth* Day of *February 1983*

[SEAL]

*Attest:*

GERALD J. MOSSINGHOFF

*Attesting Officer*

*Commissioner of Patents and Trademarks*